US005608691A

United States Patent [19]

MacLauchlan et al.

[11] Patent Number: 5,608,691

[45] Date of Patent: Mar. 4, 1997

[54] EMAT WITH INTEGRAL ELECTROSTATIC SHIELD

[75] Inventors: Daniel T. MacLauchlan, Lynchburg Township; Paul J. Latimer, Lynchburg; Wayne M. Latham, Forest, all of Va.

[73] Assignee: The Babcock & Wilcox Company, New Orleans, La.

[21] Appl. No.: 503,777

[22] Filed: Jul. 18, 1996

Related U.S. Application Data

[63] Continuation-in-part of Ser. No. 251,542, May 31, 1994, Pat. No. 5,436,873.

[51] Int. Cl.[6] ..... H04R 23/00

[52] U.S. Cl. ..... 367/140; 73/643

[58] Field of Search ..... 73/643; 367/140

[56] References Cited

U.S. PATENT DOCUMENTS

| | | | |
|---|---|---|---|
| 4,149,421 | 4/1979 | Böttcher et al. | 73/643 |
| 4,296,486 | 10/1981 | Vasile | 367/140 |
| 4,777,824 | 10/1988 | Alers et al. | 73/643 |
| 5,140,860 | 8/1992 | Hüsherelrath et al. | 73/643 |
| 5,164,921 | 11/1992 | Graff et al. | 367/140 |
| 5,436,873 | 7/1995 | MacLauchlan et al. | 367/140 |

*Primary Examiner*—J. Woodrow Eldred
*Attorney, Agent, or Firm*—Robert J. Edwards; Eric Marich

[57] ABSTRACT

A shield for an electromagnetic acoustic transducer (EMAT) has multiple layers of electrically insulating and electrically conductive materials which contain a coil of the EMAT. A first insulating layer lies directly on top of the coil and is attached thereto by a suitable layer of non-conductive adhesive. A second layer having both insulating and conductive portions is provided on a side of the coil opposite the first insulating layer such that the coil is completely encapsulated within and in direct contact only with the insulating portions of the first and second layers. The insulating portion of the second layer has a high electrical resistance. A third, conductive layer having a conductive adhesive side is provided in contact with the conductive portion of the second layer. The third layer is also provided with a window extending completely therethrough having dimensions coextensive with those of the coil; shielding of the coil itself by this third layer is thus prevented. Finally, a fourth insulating layer preferably made of a thin layer of ultrahigh molecular weight polyethylene or similar insulating material is attached to the underlying third, conductive layer by adhesive means.

An alternative shield and coil arrangement is also disclosed, wherein the coil is etched on one side of a substrate and a corresponding shield configuration is etched on the other side, resulting in an integrated shield and coil assembly for use in an electromagnetic acoustic transducer.

26 Claims, 4 Drawing Sheets

EMAT # 1 - METALIZED PLASTIC SHIELD
EMAT # 2 - FINE GRATING COPPER SHIELD
EMAT # 3 - COPPER STRIP SHIELD

EMAT WITH INTEGRAL ELECTROSTATIC SHIELD

CROSS REFERENCE TO RELATED APPLICATION

The present application is a continuation-in-part application of Ser. No. 08/251,542, filed May 31, 1994 and to issue on Jul. 25, 1995 as U.S. Pat. No. 5,436,873.

FIELD AND BACKGROUND OF THE INVENTION

The present invention relates in general to ultrasonic testing and electromagnetic acoustic transducers (EMATs) and, in particular, to a new and useful electrostatic shield for a coil of an electromagnetic acoustic transducer for reducing noise from various sources.

Current ultrasonic tests are contact techniques in which a piezoelectric transducer is coupled to a component surface by a fluid or gel. For electrically conductive materials, ultrasonic waves can be produced by electromagnetic acoustic wave induction. Electromagnetic acoustic transducers (EMATs) are the basis of a noncontact ultrasonic inspection method that requires no fluid couplant because the sound is produced by an electromagnetic acoustic interaction within the material. This technique can be used to eliminate the couplant, which complicates testing procedures, slows inspection rates, and can introduce errors into the measurement. In fact, in some cases, conventional ultrasonic tests cannot even be conducted because of the couplant.

In contrast to conventional contact ultrasonic testing, where a mechanical pulse is coupled to the workpiece being inspected, in an EMAT, the acoustic wave is produced by the interaction of a magnetic field with induced surface currents. The coil of the EMAT induces eddy currents at the surface of the conductor. A constant magnetic field provided by an AC, DC or pulse driven electromagnet or a permanent magnet is positioned near the coil. The interaction of the magnetic field with the induced eddy currents produces a force called the Lorentz force. This Lorentz force interacts with the material to produce an ultrasonic pulse. As shown in FIG. 1, a simple EMAT 10 consists of a coil of wire 12 and a permanent or electromagnet 14. A strong magnetic field, B, is produced at the surface of an electrically conductive workpiece 16 being tested by the permanent magnet or electromagnet 14. Eddy currents EC with density J are induced in a surface 18 of the workpiece 16 by the coil 12 which is driven at a high excitation frequency by an oscillator 20 (not shown). The Lorentz force F resulting from the alternating current flow in the presence of the magnetic field is transferred to the workpiece 16 and produces an ultrasonic wave UW (with the same frequency as the excitation frequency) that propagates through the workpiece 16.

Various configurations of the coil 12 may be used along with different directions of the magnetic field B to produce a variety of ultrasonic wave modes, with unique properties in addition to the conventional longitudinal and shear vertical (S.V.) shear waves. In conductors that are ferromagnetic, a second force (magnetostriction) is added to the Lorentz force, which makes ferromagnetic materials particularly suitable for sensitive EMAT inspection.

EMAT instrumentation involves the reception of low level signals; as such, EMATs are susceptible to noise pickup from many different sources. To minimize noise pickup, careful shielding and grounding is very important. This aspect has been recognized from the very early stages of EMAT development, and the use of shielded cables and instrumentation is well documented in the literature.

Vasile (U.S. Pat. No. 4,296,486) discloses shielded electromagnetic acoustic transducers including a source of magnetic flux (28, 30, 32, 34, 36) for establishing a static magnetic field, an electrical conductor (38) for conducting an alternating current in the static magnetic field, and an electrically conductive, nonmagnetic shield (46) disposed between the source of magnetic flux and the conductor. In the preferred embodiment, the shield (46) is provided in the form of a thin metallic sheet in contact with the source of magnetic flux and spaced from the conductor. As discussed at Col. 4, lines 3–15 of Vasile, the shield (46) acts as a ground plane and reduces losses associated with the eddy currents which are induced in the magnets by the coil (38), and the shield (46) also helps to reduce the impedance level of the EMAT (26), while causing only a minimal loss in the magnetic field strength.

Vasile thus shields his magnet from the EMAT. However, there is no known mention of shielding of the actual EMAT coil itself from the workpiece or conductor, despite the fact that the EMAT coil acts as an antenna for noise pickup from the conductor being tested as well as from electromagnetic radiation sources.

The present invention addresses this overlooked aspect and presents a unique approach to shielding EMAT coils that can provide a totally shielded EMAT system when used with the aforementioned shielded cables and instrumentation.

SUMMARY OF THE INVENTION

One aspect of the present invention is drawn to a shield for a coil of an electromagnetic acoustic transducer (EMAT). The shield has multiple layers of electrically insulating and electrically conductive materials which contain the coil therein. A first layer, made of electrically insulating material, lies directly on top of the coil and is attached thereto by a suitable layer of non-electrically conductive adhesive. A second layer, made of material having both electrically insulating and electrically conductive portions, is provided on a side of the coil opposite the first layer such that the coil is completely encapsulated within and in direct contact only with the electrically insulating portions of the first and second layers. The electrically insulating portion of the second layer has a high electrical resistance. A third layer, made of electrically conductive material, has an electrically conductive adhesive side which contacts the electrically conductive portion of the second layer. The third layer is also provided with a window extending completely therethrough and having dimensions coextensive with those of the coil to prevent shielding by the third layer of signals produced by the coil itself. Finally a fourth layer made of thin, durable, electrically insulating material is provided and attached to the underlying third, electrically conductive layer by adhesive means.

Alternatively, a second embodiment of the present invention provides a more economical shielding. An integral shield and coil are combined on a single substrate produced in the same manner as a conventional circuit board using photo-resist processes. The coil is printed on one side, and the corresponding shield is printed on the other. This embodiment reduces the cost of production of the invention because both sides may be etched at the same time. Also, it has the additional advantage of being more durable than the multi-layered embodiment.

Thus there is provided an integrated shield and coil assembly for an electromagnetic acoustic transducer (EMAT). The assembly comprises a substrate, having first and second surfaces on which electrical circuits can be etched. A coil pattern having conductors is etched onto the first surface of the substrate, and a shield pattern, having a configuration corresponding to and aligned with the coil pattern, to substantially shield the coil pattern from electrostatic noise present on the workpiece and to prevent eddy current generation in the shield caused by the coil pattern, is etched onto the second surface of the substrate.

Another aspect of the present invention is drawn to a shielded electromagnetic acoustic transducer (EMAT) sensor assembly for inspecting a workpiece and having a magnet, a coil, and a shield having multiple layers of electrically insulating and electrically conductive materials which contain the coil therein, the shield comprising the aforementioned structure, the first layer of the shield being located proximate to the magnet, together with means for securing the shield containing the coil to the magnet so that the fourth layer is located proximate to the workpiece.

Alternatively, a second enhancement of the EMAT sensor assembly for inspecting a workpiece utilizes substantially the same general components as the EMAT sensor assembly described above, but replaces the multi-layered shield and coil with the integral shield and coil assembly described above.

Thus there is provided a shielded electromagnetic acoustic transducer (EMAT) sensor unit for inspecting a workpiece and having a magnet, and an integrated coil and shield assembly, the assembly comprising a substrate, having first and second surfaces on which electrical circuits can be etched. A coil pattern is etched onto the first surface of the substrate, and a shield pattern, having a configuration corresponding to and aligned with the coil pattern, to substantially shield the coil pattern from electrostatic noise present on the workpiece and to prevent eddy current generation in the shield caused by the coil pattern, is etched onto the second surface of the substrate. Finally, means are provided for securing the substrate to the magnet so that the second surface of the substrate is located proximate the workpiece during an inspection.

The various features of novelty which characterize the invention are pointed out with particularity in the claims annexed to and forming a part of this disclosure. For a better understanding of the invention, its operating advantages and specific results attained by its uses, reference is made to the accompanying drawings and descriptive matter in which a preferred embodiment of the invention is illustrated.

DESCRIPTION OF THE PREFERRED EMBODIMENTS

The present invention pertains to an electromagnetic shield covering for a coil of an electromagnetic acoustic transducer (EMAT). When utilizing EMATs, transduction takes place within an electromagnetic skin depth of the surface of the workpiece being tested. Thus, it is necessary that the electromagnetic shield for the EMAT coil, according to the present invention, have a thickness which is much less than a skin depth in the shield material at the frequency of the test in order to avoid exciting ultrasonic waves in the covering forming the shield itself or to avoid attenuating the electromagnetic coupling of the EMAT to the workpiece.

Figure 1:
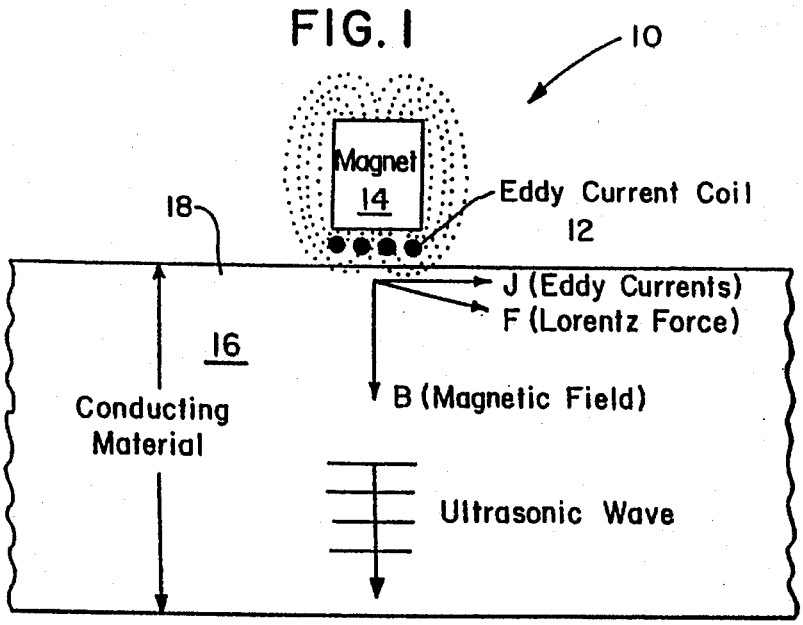
FIG. 1 is a schematic representation of a typical electromagnetic acoustic transducer (EMAT) sensor assembly located adjacent to a workpiece to be tested.
Figure 2:
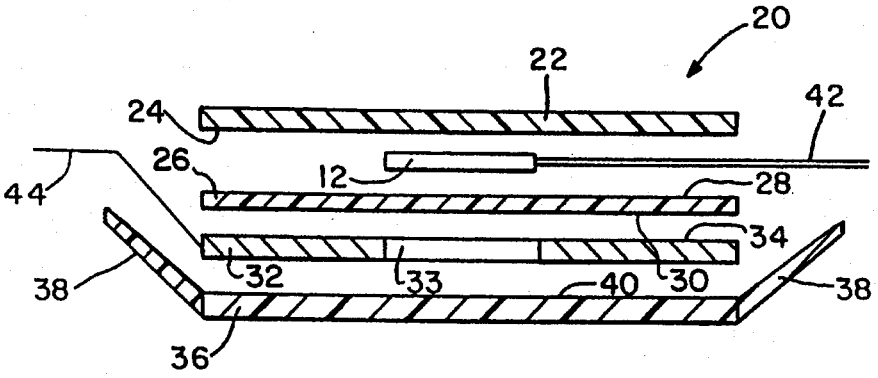
FIG. 2 is an exploded side view of an electrostatic shield for a coil of an EMAT sensor assembly according to the teachings of the present invention.
Figure 3:
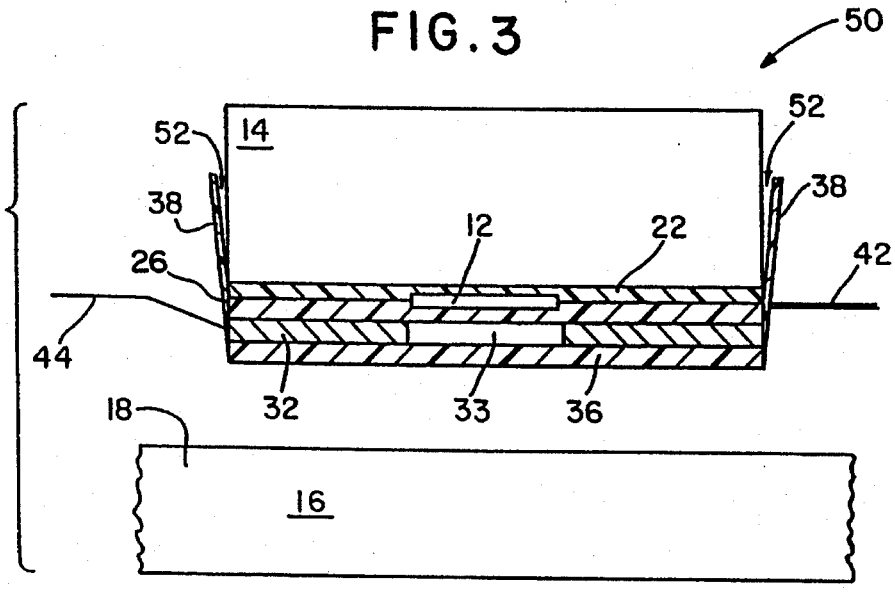
FIG. 3 is a side view of an EMAT sensor assembly with the shielded coil of FIG. 2 according to the teachings of the present invention.

Referring to the drawings generally, wherein like numerals designate the same or similar elements throughout the several drawings, and to FIGS. 2 and 3, one aspect of the present invention is drawn to an electrostatic shield 20 for a coil 12 of an EMAT sensor assembly 50. The shield 20 is comprised of multiple layers of electrically insulating and electrically conductive materials which contain the coil 12 therein.

The first layer, which when applied as a part of the EMAT sensor assembly 50 would be nearest the magnet 14, is an electrically insulating layer 22. It is preferably comprised of a polyimide such as Kapton®, Teflon®, or Mylar® (all trademarks of E.I. DuPont de Nemours and Co.) or similar materials. Electrically insulating layer 22 lies directly on top of coil 12 and is attached thereto by a suitable layer of non-electrically conductive adhesive 24. The layer 22 is preferably made from Kapton® tape; alternatively, it can comprise a Kapton® substrate on which a flexible copper EMAT coil 12 has been etched. The material for layer 22 can be virtually any type of insulating material depending upon the application. In some applications, a flexible material is preferred. In other applications, such as high temperature testing, an insulator with good high temperature properties such as Kapton® or a ceramic would be preferred. Since this layer 22 does not go between the EMAT coil 12 and the workpiece 16 being inspected, there is no requirement to keep this layer 22 as thin as possible to minimize signal loss.

A second layer 26 having both electrically insulating and electrically conductive portions is provided on a side of the coil 12 opposite the first electrically insulating layer 22, and preferably comprises a thin (approximately 0.5–2 mils thick to minimize signal loss) layer of metalized plastic such as aluminized polypropylene, or similar material, having an electrically conductive surface on one side and an electrically insulating surface on the other. The electrically insulating surface would go up against the EMAT coil 12, while the other electrically conductive surface is on the opposite side. The electrically conductive surface is much thinner than the skin depth in this electrically conductive material, at the ultrasonic frequencies being used.

Alternatively, second layer 26 could be comprised of two separate sub-layers, one being the electrically conductive portion while the other is the electrically insulating portion, to provide the required characteristics. The electrically insulating layer could be virtually any thin insulating material such as plastic, fiberglass, or ceramic. The electrically conductive layer could be virtually any thin, conductive metal, such that the thickness is much less than a skin depth at the ultrasonic frequency. These metals could be copper, aluminum, gold, silver, titanium, stainless steel, etc. The thin layer of aluminized polypropylene 26 has a fairly high resistance and is typically very fragile. The polypropylene side 28 of layer 26 is in contact with the coil 12 while aluminized side 30 is opposite the polypropylene side and in contact with a third, electrically conductive layer 32 described below. As such, the coil 12 is completely encapsulated within and in direct contact only with the electrically insulating materials or portions thereof comprising layers 22 and 26.

The third, electrically conductive layer 32 is preferably a layer of thin (0.5–2 mils thick) conductor such as copper, aluminum, or silver having an electrically conductive adhesive side 34 in contact with the aforementioned electrically conductive portion of the second layer 26, such as the aluminized side 30 of aluminized polypropylene layer 26. This material provides a low resistance path for noise potentials picked up on the thin conductor of the second layer 26 to be shorted to the preamplifier common (not shown). This layer 32 should not cover the EMAT coil 12 itself, since it would severely attenuate the electromagnetic coupling between the EMAT coil 12 and the workpiece 16. As such, electrically conductive layer 32 is provided with a window or aperture 33 extending completely through electrically conductive layer 32 and having dimensions coextensive with those of the EMAT coil 12; shielding of the EMAT coil 12 signals by this third electrically conductive layer 32 is thus prevented.

Finally a fourth electrically insulating layer 36, advantageously comprising a thin (1–10 mils thick) layer of ultra-high molecular weight polyethylene tape or similar electrically insulating material, is provided. This layer 36 provides electrical insulation of the workpiece 16 from the EMAT sensor assembly 50, and in some scanning applications provides a durable wear surface. Electrically insulating layer 36 could also be made of fiberglass, plastic, or ceramic depending on the application. Attachment tabs 38 are provided on opposite ends of this layer 36 to facilitate attachment of the entire shielded EMAT sensor assembly 50 to sides 52 of the magnet 14, as is shown in FIG. 3. Electrically insulating layer 36 is attached to the underlying third, electrically conductive layer 36 by means of adhesive backing or tape 40. In some constructions, this fourth layer 36 may be comprised of two separate layers. The outermost layer which would contact the workpiece 16 would be a thin (1–3 mils thick) layer of poorly conducting metal such as titanium or stainless steel. The particular material is chosen to produce very little attenuation to the produced EMAT signals, and to provide a rugged wear surface in hostile environments. The second layer would be a thin (1–3 mils thick) electrically insulating layer to insulate the EMAT shields from the metal wear surface. The second layer could be virtually any thin electrically insulating material such as plastic, ceramic, or fiberglass.

To complete the shielded EMAT sensor assembly 50, leads 42 are provided to electrically connect the coil 12 with EMAT coil electronics (not shown) in a manner well known to those skilled in the art. Leads 44 are also provided to a receiver common or ground terminal (also not shown) to provide an electrostatic shield to noise potentials on a workpiece 16.

The fourth, electrically insulating layer 36 provides a durable wear surface for the EMAT 50, and the combination of the thin layer 26 of aluminized polypropylene or similar material over the active part of the EMAT coil 12 surrounded by the electrically conductive layer 32 allows the EMAT sensor assembly 50 to send and receive signals with virtually no loss in signal amplitude while providing a low resistance shield to capacitively coupled noise.

A second embodiment of the invention involves a variation in the construction of the shield and coil. This aspect is shown in FIGS. 4–8 and is generally referred to as an integral electrostatic shield and coil assembly 70.

Figure 4:
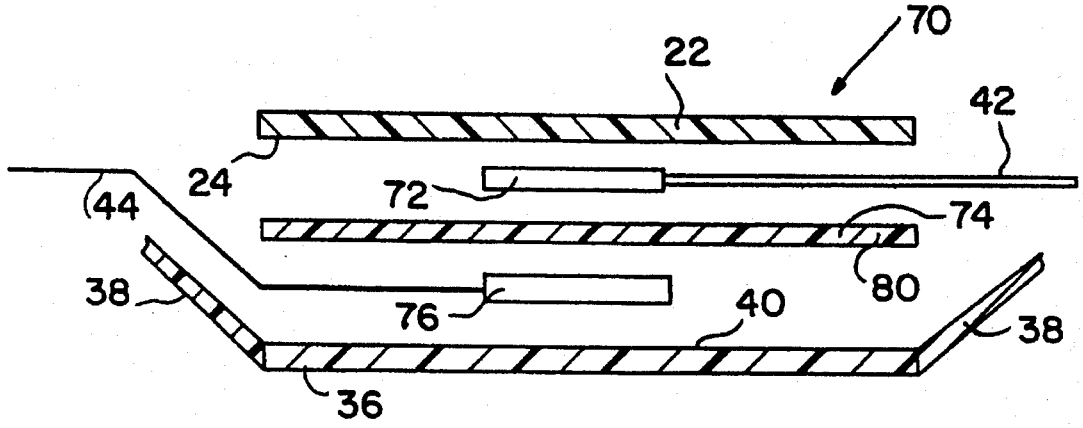
FIG. 4 is an exploded side view of a second embodiment of an integral electrostatic shield and coil assembly for an EMAT sensor assembly according to the teachings of the present invention.
Figure 5:
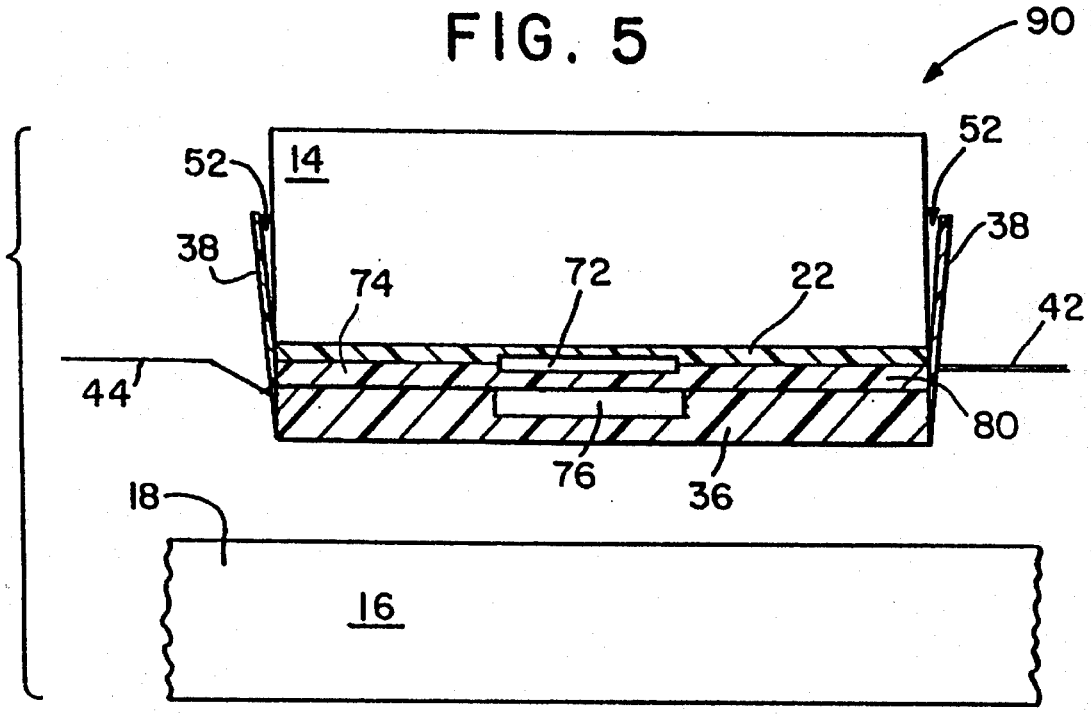
FIG. 5 is a side view of a second embodiment of an EMAT sensor assembly with the integral electrostatic shield and coil assembly of FIG. 4 according to the teachings of the present invention.

FIGS. 4 and 5 depict the integral electrostatic shield and coil assembly 70. In this embodiment, the integral shield and coil assembly 70 comprises three layers. The first and third layers of the integral shield and coil assembly 70 have essentially the same structure and function as the aforementioned electrically insulating layers 22 and 36 described earlier in connection with the electrostatic shield 20, and are located proximate the magnet 14 and workpiece 16, respectively. The unique aspect of this embodiment, however, is the construction of a middle layer 80 which carries both an EMAT coil 72 and an electrostatic shield 76 of a particular pattern or configuration.

Figure 6:
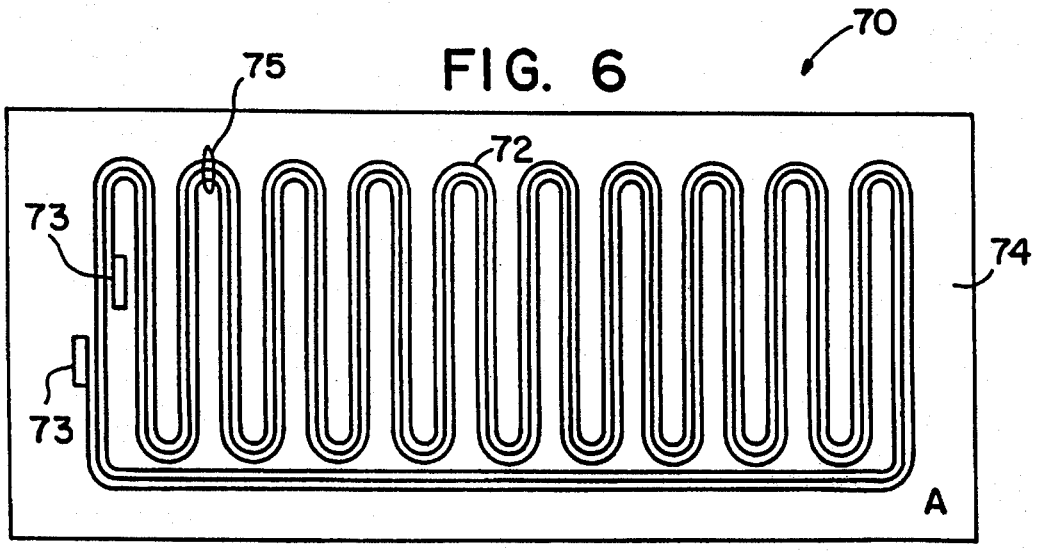
FIG. 6 is a schematic representation of one side of a substrate having an EMAT coil whose conductors are created/printed by a photo etching process on that side of the substrate.

Middle layer 80 advantageously comprises a polyimide substrate 74, such as KAPTON®. The EMAT coil conductors 72 and the electrostatic shield conductors 76 are provided on opposite sides (side A and side B, respectively) of the substrate 74 and are created/printed directly thereon by means of well-known photo-resist methods and the like. The materials of these conductors is preferably copper due to its relatively low cost, but other conductive materials used in printed circuits or the like could also be employed. FIG. 6 discloses one particular coil pattern or configuration 72 having one or more conductors, preferably 3–5 conductors, on the polyimide substrate 74. Terminals 73 are provided at the ends of conductors 72 for connection with the leads 42 in known manner. If necessary the terminals 73 or other portions of both the coil and shield elements could be plated with gold. Thus, the middle layer 80 is actually a two-sided, flexible printed circuit, on which both the coil 72 and shield 76 are produced at the same time.

The shield pattern or configuration 76 has one or more conductors and corresponds to and is aligned with the coil pattern or configuration 72 etched on the opposite side of the substrate 74. Regardless of their pattern or configuration, the etched coil 72 and etched shield 76 are coextensive with and aligned with one another such that copper shielding elements or strips 78 of the shield 76 cover the EMAT coil 72 conductors. Pads 77 are provided to shield the terminals 73; terminal 79 is provided on one end of the shield pattern 76 for connection to the leads 44 for connection to the receiver common or ground terminal (not shown) to provide an electrostatic shield to noise potentials on a workpiece, by providing a low resistance path for such noise potentials picked up by the shield 76 (or 100, infra) which are then shorted to the preamplifier common (again not shown). As shown in FIG. 5, the integral shield and coil assembly 70 is "sandwiched" between layers 22 and 36 and is thus secured to the magnet 14 to create a shielded EMAT sensor assembly 90.

The primary advantage of this embodiment is that the electrostatic shield 76 is fabricated at the same time as the EMAT coil 72. The integral coil and shield assembly 70 is able to eliminate capacitively coupled noise without affecting EMAT signal amplitude, and since it is created at the same time as the EMAT coil 72, by etching copper on a polyimide substrate, fabrication of the shield assembly 70 and creation of the EMAT sensor assembly 90 employing same is greatly simplified. Additionally, the integral shield and coil assembly 70 is much more durable than the embodiment disclosed in FIGS. 2 and 3.

Figure 7:
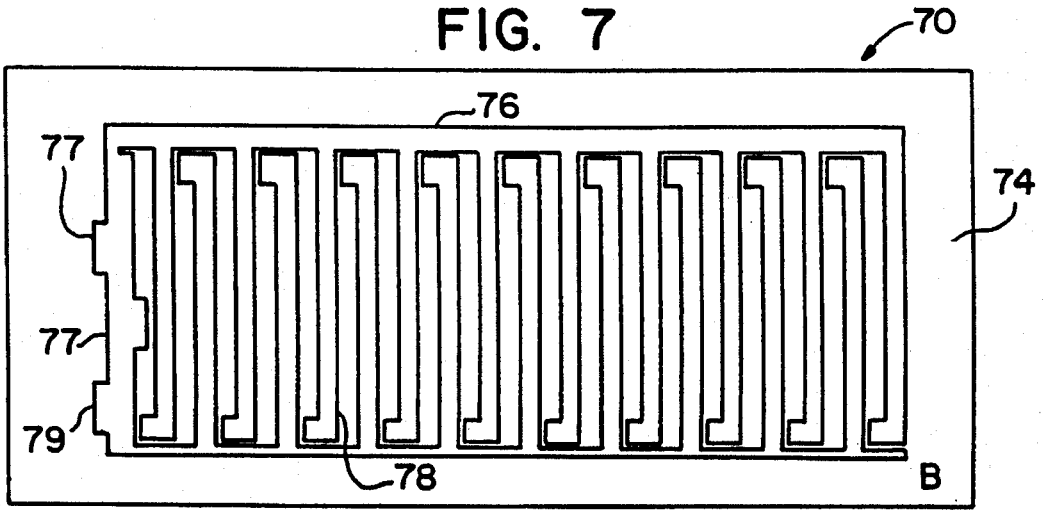
FIG. 7 is a schematic representation of an electrostatic shield configuration having conductive shielding elements which are created/printed by a photo etching process on the opposite side of the substrate of FIG. 6, and wherein the conductive shielding elements comprise thin copper strip conductors which correspond to and are aligned with the EMAT coil conductors of FIG. 6 so that the conductive shielding elements substantially cover the EMAT coil conductors to minimize noise.
Figure 8:
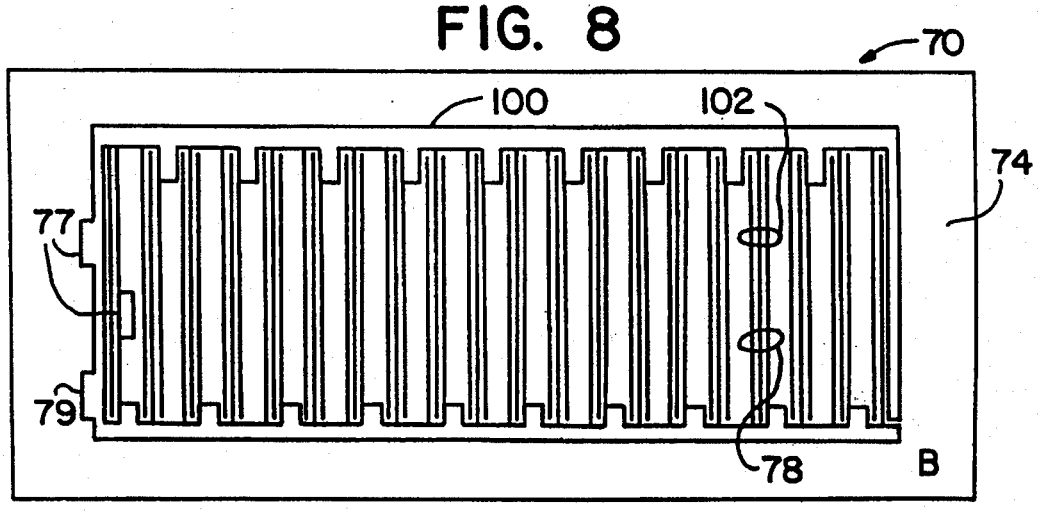
FIG. 8 is a schematic representation of an alternative embodiment of the integral electrostatic shield configuration of FIG. 7 having conductive shielding elements which would also be created/printed on the opposite side of the substrate of FIG. 6 by a photo etching process, wherein each of the conductive shielding elements comprise a fine grating of several closely spaced, thin copper strip conductors, and wherein the shielding elements correspond to and are aligned with the EMAT coil conductors of FIG. 6 so that they substantially cover the EMAT coil conductors to minimize noise.

FIG. 8 discloses an alternative embodiment of the electrostatic shield configuration of FIG. 7, generally referred to as an integral grating shield assembly 100. Integral grating shield assembly 100 is created/printed on the opposite side of the substrate 74 of FIG. 6 (instead of the configuration of FIG. 7) using well-known photo etching or photo-resist methods. In this embodiment, each of the shield elements 78 comprise a fine grating 102 of multiple, closely spaced, thin copper strip conductors, advantageously numbering three to five or more. The grating elements 102 again correspond to and are aligned with the EMAT coil conductors 72 on the opposite side of the substrate 74 so that they substantially cover the EMAT coil conductors 72 to minimize noise. The overall width of the grating elements 102 (as is the overall width of the shielding elements 78 of FIG. 7) is selected to be the same as the overall width of the coil conductors 72. The number of grating elements 102 will generally be the same as the number of EMAT coil conductors 72, but this is not an absolute requirement. Greater or fewer numbers of grating elements 102 can be employed. The width of each of the individual grating elements 102 is preferably the smallest that can be economically provided using the aforementioned photo etching or photo-resist processes. They are generally 10–12 mils (1 mil=0.001") wide and separated by a 10–12 mil gap, but they can be as small as 5 mils wide with a 5 mil gap separating them from one another. The important feature is that the pattern or configuration of the shielding elements 78 or 102 is coextensive with and aligned with the pattern or configuration of the EMAT coil conductors 72 on the opposite side of the substrate 74 to properly perform their shielding function.

There are also some differences in the principle of operation of the shield assembly of FIGS. 2 and 3 and that of the embodiments of the integral shield and coil assemblies of FIGS. 4–8. As indicated earlier, the EMAT coil generates radio frequency magnetic fields which induce eddy currents in the surface of the metal part being tested. With the electrostatic shield assembly 20, a layer of metalized plastic is placed between the coil and the workpiece 16 being tested. The metalized layer is much thinner than an electromagnetic skin depth at the frequency of operation, which allows the magnetic fields to pass through it virtually unhindered. With the integral shield and coil assembly 70, the thickness of the shield metal can be thicker than an electromagnetic skin depth. A pattern is etched into the shield layer 76 that prevents eddy currents from being generated in the shield 76. By preventing eddy current generation in the shield layer 76, the magnetic fields can pass through it unhindered, and yet again the etched shield layer 76 serves as a barrier to electrostatically coupled noise.

Figure 9:
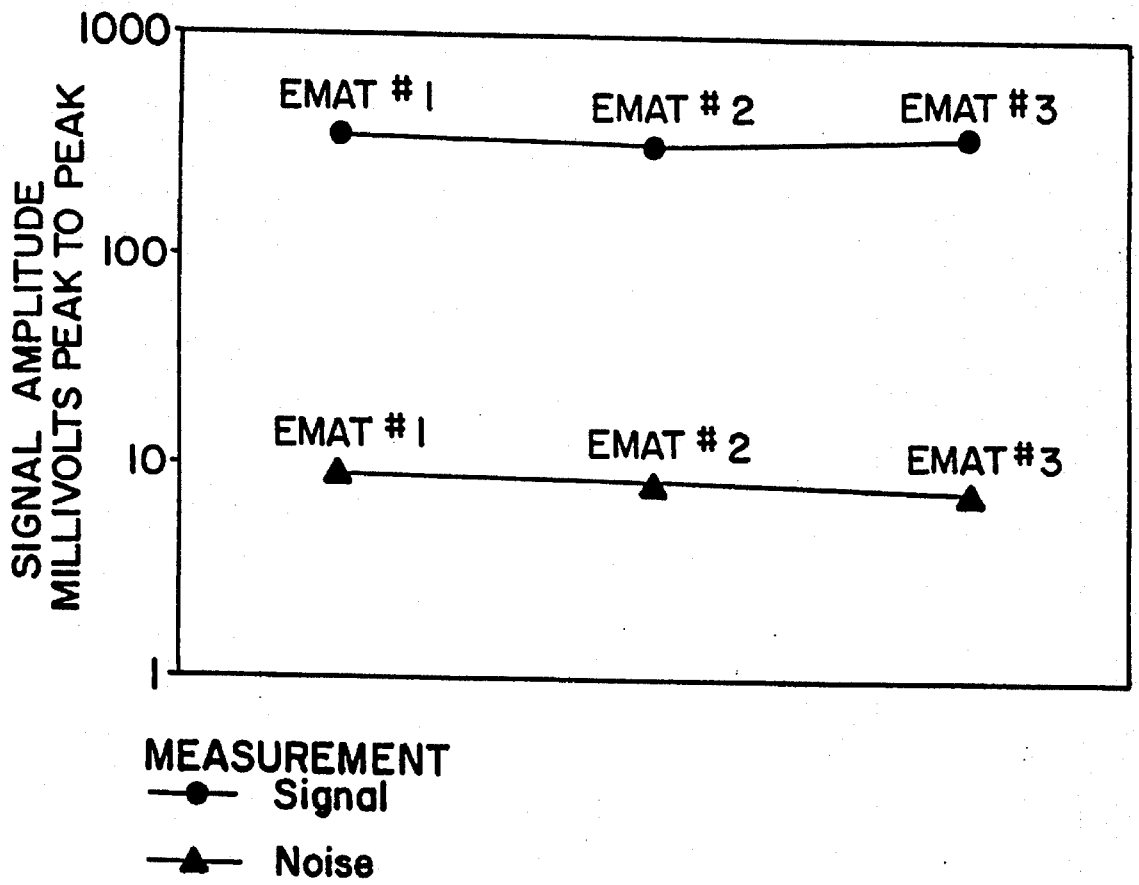
FIG. 9 is a graph showing the results of a test of the electrostatic shield of FIGS. 2 and 3, and the integral electrostatic coil and shield assembly of FIGS. 4 through 8 when used as part of an EMAT sensor assembly, comparing noise to signal amplitude.

FIG. 9 shows signal amplitudes and noise amplitudes for three separate embodiments of the present invention. In FIG. 9, EMAT #1 is a multi-layer shield type, EMAT #2 is an integrated shield and coil type, and EMAT #3 is also an integrated shield and coil type, but with a different shield configuration. All three types of EMAT show good results. The signal-to-noise (SNR) ratio improves slightly from embodiment to embodiment, to where the highest SNR ratio (and lowest noise amplitude) is achieved by using the integrated coil and shield.

While specific embodiments of the invention have been shown and described in detail to illustrate the application of the principles of the invention, it will be understood that the invention may be embodied otherwise without departing from such principles.

We claim:

1. An integrated shield and coil assembly for an electromagnetic acoustic transducer (EMAT), comprising:

a substrate, having first and second surfaces on which electrical circuits can be etched;

a coil pattern, having conductors etched onto the first surface of the substrate; and a shield pattern, having a configuration corresponding to and aligned with the coil pattern, to substantially shield the coil pattern from electrostatic noise present on the workpiece and to prevent eddy current generation in the shield caused by the coil pattern, etched onto the second surface of the substrate.

2. The integrated shield and coil assembly according to claim 1, wherein the substrate comprises a polyimide material.

3. The integrated shield and coil assembly according to claim 1, wherein the substrate comprises a polyimide material on which the coil pattern has been etched as a flexible copper coil.

4. The integrated shield and coil assembly according to claim 1, wherein the shield pattern comprises a fine grating copper shield.

5. The integrated shield and coil assembly according to claim 1, wherein the shield pattern comprises a copper strip shield.

6. The integrated shield and coil assembly according to claim 1, wherein the coil pattern and the shield pattern each comprise one or more conductors.

7. The integrated shield and coil assembly according to claim 1, wherein the shield pattern on the second surface is coextensive with and aligned with the coil pattern on the first surface to eliminate capacitively coupled noise.

8. The integrated shield and coil assembly according to claim 1, further comprising a layer of electrically insulating material lying directly on the coil pattern and substrate and attached thereto by a suitable layer of non-electrically conductive adhesive.

9. The integrated shield and coil assembly according to claim 8, wherein the layer of electrically insulating material lying directly on the coil pattern and substrate and attached thereto by a suitable layer of non-electrically conductive adhesive comprises a polyimide material.

10. The integrated shield and coil assembly according to claim 8, wherein the layer of electrically insulating material lying directly on the coil pattern and substrate and attached thereto by a suitable layer of non-electrically conductive adhesive comprises a ceramic material.

11. The integrated shield and coil assembly according to claim 8, wherein the layer of electrically insulating material lying directly on the coil pattern and substrate and attached thereto by a suitable layer of non-electrically conductive adhesive comprises an insulator with good high temperature properties.

12. The integrated shield and coil assembly according to claim 1, further comprising a layer of thin, durable, electrically insulating material lying directly on the shield pattern and substrate and attached thereto by adhesive means.

13. The integrated shield and coil assembly according to claim 12, wherein the layer of thin, durable, electrically insulating material lying directly on the shield pattern and substrate and attached thereto by adhesive means comprises two separate layers, one being a layer of poorly conducting metal located proximate a workpiece during an inspection to provide a rugged wear surface in hostile environments and the other being attached to the shield pattern and substrate by the adhesive means to insulate the shield pattern from the layer of poorly conducting metal.

14. A shielded electromagnetic acoustic transducer (EMAT) sensor unit for inspecting a workpiece and having a magnet, and an integrated coil and shield assembly, the assembly comprising:

a substrate, having first and second surfaces on which electrical circuits can be etched;

a coil pattern, etched onto the first surface of the substrate; and a shield pattern, having a configuration corresponding to and aligned with the coil pattern, to substantially shield the coil pattern from electrostatic noise present on the workpiece and to prevent eddy current generation in the shield caused by the coil pattern, etched onto the second surface of the substrate; and means for securing the substrate to the magnet so that the second surface of the substrate is located proximate the workpiece during an inspection.

15. The EMAT sensor unit according to claim 14, wherein the substrate comprises a polyimide material.

16. The EMAT sensor unit according to claim 14, wherein the substrate comprises a polyimide material on which the coil pattern has been etched as a flexible copper coil.

17. The EMAT sensor unit according to claim 14, wherein the shield pattern comprises a fine grating copper shield.

18. The EMAT sensor unit according to claim 14, wherein the shield pattern comprises a copper strip shield.

19. The EMAT sensor unit according to claim 14, wherein the coil pattern and the shield pattern each comprise one or more conductors.

20. The EMAT sensor unit according to claim 14, wherein the shield pattern on the first surface is coextensive with and aligned with the coil pattern on the second surface to eliminate capacitively coupled noise.

21. The EMAT sensor unit according to claim 14, further comprising a layer of electrically insulating material lying directly on the coil pattern and substrate and attached thereto by a suitable layer of non-electrically conductive adhesive.

22. The EMAT sensor unit according to claim 21, wherein the layer of electrically insulating material lying directly on the coil pattern and substrate and attached thereto by a suitable layer of non-electrically conductive adhesive comprises a polyimide material.

23. The EMAT sensor unit according to claim 21, wherein the layer of electrically insulating material lying directly on the coil pattern and substrate and attached thereto by a suitable layer of non-electrically conductive adhesive comprises a ceramic material.

24. The EMAT sensor unit according to claim 21, wherein the layer of electrically insulating material lying directly on the coil pattern and substrate and attached thereto by a suitable layer of non-electrically conductive adhesive comprises an insulator with good high temperature properties.

25. The EMAT sensor unit according to claim 14, further comprising a layer of thin, durable, electrically insulating material lying directly on the shield pattern and substrate and attached thereto by adhesive means.

26. The EMAT sensor unit according to claim 25, wherein the layer of thin, durable, electrically insulating material lying directly on the shield pattern and substrate and attached thereto by adhesive means comprises two separate layers, one being a layer of poorly conducting metal located proximate a workpiece during an inspection to provide a rugged wear surface in hostile environments and the other being attached to the shield pattern and substrate by the adhesive means to insulate the shield pattern from the layer of poorly conducting metal.

* * * * *